US007182232B2

(12) United States Patent
Fleming et al.

(10) Patent No.: US 7,182,232 B2
(45) Date of Patent: Feb. 27, 2007

(54) ADJUSTABLE DROP LOOP GARMENT HANGER

(75) Inventors: Patrick J. Fleming, Cuyahoga Falls, OH (US); David S. Deryck, Akron, OH (US)

(73) Assignee: GHA Brands Limited, Labuan (MY)

( * ) Notice: Subject to any disclaimer, the term of this patent is extended or adjusted under 35 U.S.C. 154(b) by 145 days.

(21) Appl. No.: 10/876,809

(22) Filed: Jun. 25, 2004

(65) Prior Publication Data

US 2005/0284899 A1 Dec. 29, 2005

(51) Int. Cl.
*A41D 27/22* (2006.01)

(52) U.S. Cl. ..... 223/88; 223/95

(58) Field of Classification Search ..... 223/85, 223/88, 89, 92, 94, 95; 211/113; D6/315, D6/324

See application file for complete search history.

(56) References Cited

U.S. PATENT DOCUMENTS

| | | | | |
|---|---|---|---|---|
| 352,106 | A | | 11/1886 | Benton |
| RE10,808 | E | | 2/1887 | McIlvenna et al. |
| 680,269 | A | | 8/1901 | Norris |
| 730,263 | A | | 6/1903 | Heaton |
| 924,763 | A | | 6/1909 | Grant |
| 1,030,253 | A | | 6/1912 | Doyle |
| 1,080,402 | A | | 12/1913 | Amato |
| 1,243,741 | A | | 10/1917 | Jakab |
| 1,436,714 | A | | 11/1922 | Hoerning |
| 2,850,219 | A | | 9/1958 | Glotzer |
| 2,891,707 | A | | 6/1959 | Shrom |
| 2,904,235 | A | | 9/1959 | Crockett, Jr. |
| D204,039 | S | * | 3/1966 | Roslyn et al. ..... D6/315 |
| 3,262,617 | A | | 7/1966 | McDonald et al. |
| 3,307,753 | A | * | 3/1967 | Levine et al. ..... 223/95 |
| 4,058,222 | A | | 11/1977 | Singer |
| 5,029,739 | A | * | 7/1991 | Blanchard et al. ..... 223/88 |
| 5,603,438 | A | | 2/1997 | Jugan |
| 5,613,630 | A | * | 3/1997 | Isenga et al. ..... 223/88 |
| 6,041,985 | A | | 3/2000 | Balser |

FOREIGN PATENT DOCUMENTS

| | | |
|---|---|---|
| DE | 289221 | 12/1915 |
| DE | 004231126 A1 | 3/1994 |
| EP | 000519781 A | 12/1992 |
| FR | 674400 | 10/1929 |

* cited by examiner

*Primary Examiner*—Gary L. Welch
(74) *Attorney, Agent, or Firm*—Jack Schwartz & Associates

(57) ABSTRACT

An auxiliary garment hanger for adjustably displaying, transporting and storing multiple articles of clothing. The auxiliary garment hanger is a drop loop type garment hanger comprising two parts. A first part is an elongated vertical body having a loop at one end which can be suspended from the hook of a conventional hanger. A second part is a horizontal support having fasteners for attachment to clothing and an integrated latching mechanism which allows the horizontal support to be affixed to the elongated vertical body at varying heights relative to the conventional hanger. The latch can be easily disengaged to permit the horizontal support to be re-adjusted or removed from the elongated body and reattached to another.

7 Claims, 4 Drawing Sheets

ADJUSTABLE DROP LOOP GARMENT HANGER

The present invention relates generally to two piece garment hangers. Specifically, the present invention relates to an improved drop loop garment hanger which can be adjusted to hang garments from a plurality of heights relative to a conventional hanger to which it is attached.

BACKGROUND OF THE INVENTION

It is often desirable to suspend a secondary or auxiliary garment hanger, such as for a pair of trousers, shorts or bikini bottoms, from a conventional primary or main garment hanger, which typically suspends a jacket, shirt or bikini top so that the upper body garment is displayed on the conventional hanger while the lower body garment may be simultaneously displayed from the secondary or auxiliary garment hanger which "hangs" from the upper hanger. This may be because pairing matching garments on a single two-piece garment hanger is more convenient for a customer who can simultaneously view the garments, or because hanging multiple garments from conventional hangers may take up too much horizontal space along a display rack. Accordingly, a variety of hanger arrangements has been introduced to the garment industry, one of which is the drop loop hanger.

The drop loop hanger is the auxiliary component of a two-component garment hanger. The first "upper" component is typically a conventional hanger, i.e. a shoulder-shape hanger for use with upper body clothing. The conventional hanger has at least one hook, usually disposed centrally between two shoulder portions for suspending the hanger from a rod such as that found on a retail coat rack. The second "lower" component includes a substantially vertical elongated body having a loop formed in the upper end thereof which maybe placed over the hook member of the conventional hanger, and suspended therefrom without interfering with the garment suspended from the conventional hanger. A fixture adapted to secure the lower body garment, such as a clamp is affixed at a lower end of the elongated member. Therefore, two garments may be suspended simultaneously from the conventional upper hanger and the drop loop lower hanger at a fixed distance apart.

In this regard, the drop loop hanger, and similar variations, have proven to work well for example in the display and merchandising of two-piece clothing outfits. However, because the matching garments of an outfit may have different sizes relative to one another, or display racks may be placed at varying heights relative to the floor, a drop loop hanger of one length may not be suitable for a particular garment, where a drop loop hanger of a different length might work better.

Accordingly, adjustable drop loop hangers have been proposed which overcome some of the limitations of the fixed drop loop hanger, by splitting the elongated member into two parts which are vertically movable and selectively attachable relative to each other. For example, German Patent Publication No. DE 42 31 126 A1 discloses a drop loop hanger having a hooked rod which comprises an upper portion adapted to hang from the hook of a conventional clothes hanger, and a lower portion having a second rod attached to a horizontal garment support member. The lower rod portion can be secured by a plurality of clamps to the upper rod portion at varying heights relative to the conventional clothes hanger. Thus a single drop loop hanger can be used to display a greater variety of clothing.

A significant disadvantage to this approach, however, is the complexity of the adjustment means which are not integral with either part of the auxiliary hanger. Especially in a retail environment where the efficient setup of substantial quantities of merchandise depends upon displays that are easily assembled and adjusted, complicated adjustable garment hangers such as those of the prior art address the problems of fixed-length drop loop hangers by creating new problems.

A similarly complex arrangement is disclosed in U.S. Pat. No. 5,603,438 to Jugan in which the upper and a lower hanger portions are connected in a telescoping arrangement which includes a spring-loaded chamber and locking means. The complexity of the adjustable hanger of Jugan is likely to add significantly to the cost of manufacture and the weight of the finished product. Further, the lower hanger element is not removable from the upper, conventional hanger, limiting the practical uses for the upper hanger and resulting in a bulky assembly which can be difficult to store when not in use.

Therefore, a need exists for a simple, removable drop loop garment hanger for use with a conventional garment hanger to hold multiple articles of clothing in an adjustable relationship.

A further need exists for an adjustable drop loop garment hanger with an uncomplicated latch mechanism which reduces the number of parts required to secure the adjustable elements to each other.

A still further need exists for an adjustable drop loop garment hanger, the adjustable portion of which is modular in design and is easily reconfigured or replaced.

A further need exists for an adjustable drop loop garment hanger which is capable of holding one or more garments at different heights relative to the height of the conventional garment hanger to which it is attached.

It is an object of the present invention to provide an auxiliary garment hanger adapted to be removably attached to a conventional garment hanger and to hold at least one article of clothing in an adjustable relationship relative to the conventional hanger.

It is a further object of the present invention to provide an auxiliary garment hanger having an uncomplicated or integrated latch mechanism using a minimum number of parts and which may be deployed quickly and easily.

It is a further object of the present invention to provide an auxiliary garment hanger incorporating a modular design that can easily be changed to accommodate garments which require a variety of fastening means in order to be safely secured to a hanger.

The improved drop loop garment hanger of the present invention is designed to function with a conventional garment hanger having a shoulder-shaped cross bar and a hook disposed midway between the shoulder portions for suspending the hanger from a rod or hook. The drop loop hanger ideally has two parts: a body and a support. The body is a substantially vertical elongated structure having a securement such as a loop for attachment to the hook of a conventional hanger at an upper end thereof. The body may terminate in a taper at its lower end. The support is a substantially horizontal structure capable of holding at least one article of clothing and having a locking mechanism which may be integral with the support and which selectively engages the elongated body at varying heights therealong, thereby removably affixing the horizontal support member, and any garments attached thereto, to the body.

The drop loop garment hanger can be made adjustable by providing the body with a series of apertures (or other means) spaced along the vertical length thereof for engagement by the integral latch mechanism of the support. The integral latch ideally has a locking pin that is biased to engage the apertures, thus locking the support into position relative to the body. To vary the effective length of the drop loop hanger, the user has only to disengage the locking mechanism, as by pushing the biased latch to release the locking pin, thereby to make the auxiliary hanger adjustable in position anywhere along the length of the drop loop. Upon release of the latch at any one of the appropriate apertures, the locking pin enters an aperture and the vertical spacing once again becomes temporarily fixed.

The particular design of this embodiment avoids the problems associated with the prior art in that the adjustable drop loop is comprised of only two parts, and the assembly can easily be added to or removed from a conventional garment hanger. Additionally, the body of the drop loop garment hanger of the present invention can hold more than one horizontal support in the event that it may be desirable to display several garments from a single drop loop. Further, the present invention can be stored either assembled or disassembled, the latter allowing for compact storage of the garment hanger when not in use.

A further advantage of the particular design of the preferred embodiment of the drop loop garment hanger is that the individual body and support components are easily assembled together and configured to a desired height in a single step. Thus, the present invention enables the setup of a large number of dual height clothing displays in a short time. This is particularly important in a retail environment. The design also enables a variety of horizontal supports, each having different garment fastening means or being of different widths to be selectively installed on the same body, with or without detaching the body component from the hook of the conventional garment hanger.

It will be appreciated that the modular design of the garment hanger of the present invention allows either the body or the support components to be used multiple times. However, in the event that a single use is anticipated, the portion of the elongated structure of the body that extends below the horizontal support component may be broken off and discarded to give the drop loop garment hanger a cleaner appearance. In this case, the body may be discarded after the first use, although the horizontal portion may be reused in combination with a new body.

These and other objects, features and advantages of the present invention will become more evident from the following discussion and drawings in which:

Figure 1:
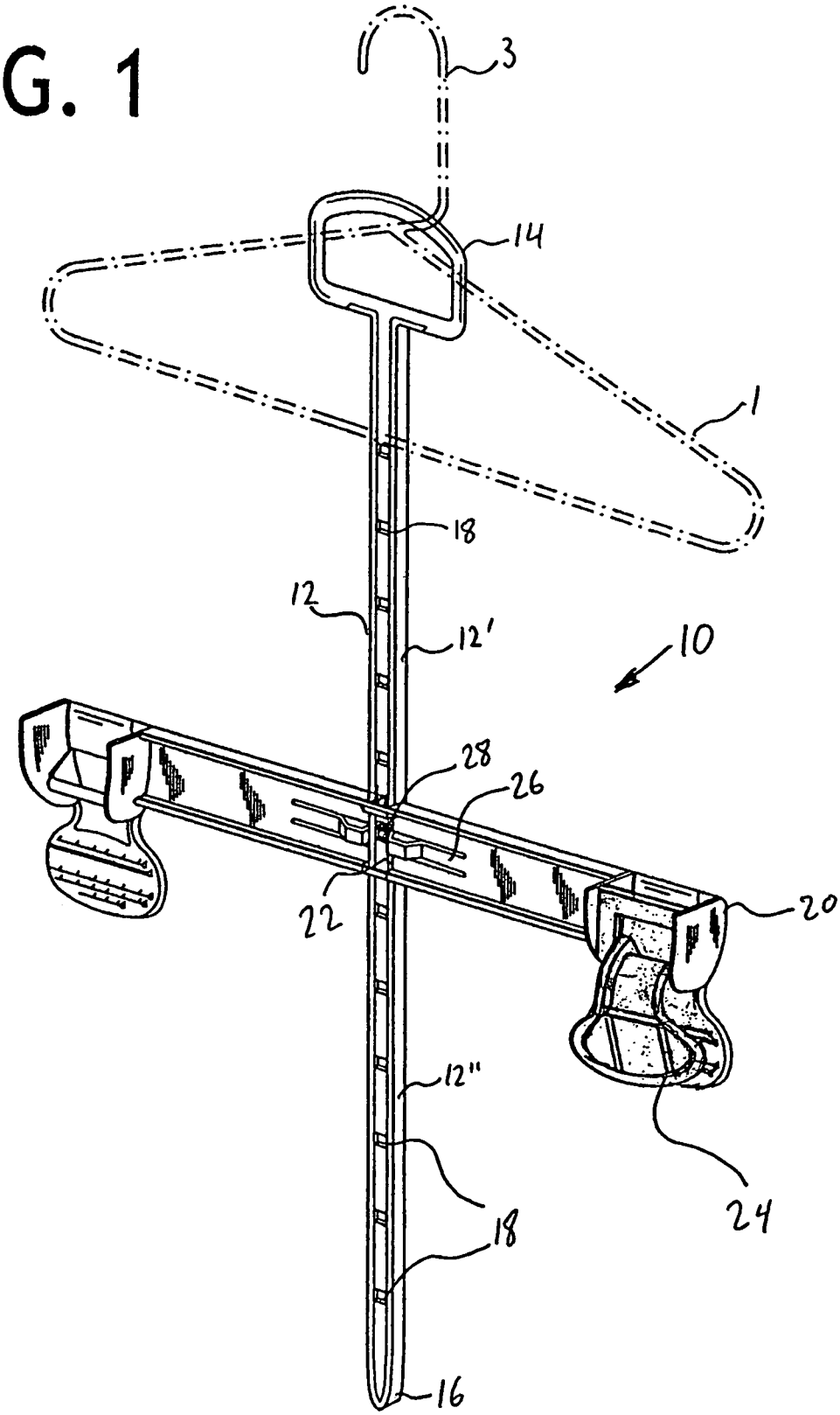
FIG. 1 is a perspective view of an embodiment of the drop loop hanger of the present invention showing the drop loop suspended from a conventional hanger.

In a preferred embodiment as shown in FIG. 1, adjustable drop loop hanger of the present invention 10 is shown as it might be used in conjunction with a conventional garment hanger 1. Drop loop hanger 10 comprises a substantially vertical elongated body 12 having a loop 14 at a top end thereof and terminating at taper 16 at a bottom end. Elongated body 12 has a substantially uniform width between loop 14 and taper 16 and has a plurality of apertures 18 disposed therein, spaced along the vertical dimension of elongated body 12.

A substantially horizontal support member 20 has garment holders or fasteners or end clips 24 located at either end thereof. In the alternative, any type of fastener capable of holding a garment could be used. A slot 22 having a width greater than or equal to the width of elongated body 12 extends through horizontal support member 20 in the vertical direction and is disposed between fasteners 24. A resilient horizontal band 26 bisects slot 22 and has a locking pin 28 disposed thereon.

During use of drop loop hanger 10, elongated body 12 is received by slot 22 in horizontal support member 20. Movement of elongated body 12 within slot 22 causes deflection of horizontal band 26 which resiliently engages locking pin 28 into one of apertures 18, thereby locking the horizontal support member 20 to elongated body 12.

Thus, when loop 14 is placed over hook 3 of a conventional hanger 1, drop loop hanger 10 can be used in conjunction with a conventional hanger two hold two pieces of clothing simultaneously. For example, a piece of clothing for the upper body, such as a shirt may be suspended from conventional hanger 1, and matching pants can be suspended from fasteners 24 on drop loop hanger 10.

Depending upon the number and positioning of apertures 18 in elongated body 12, the position of support member 20 can be fixed at one of a plurality of heights relative to conventional hanger 1. Therefore, the adjustability of the effective length of the drop loop hanger of the present embodiment depends upon the number of apertures 18 in elongated body 12, and the ease with which locking pin 28 can be temporarily disengaged, allowing support member 20 to slide freely along elongated body 12.

Figure 2:
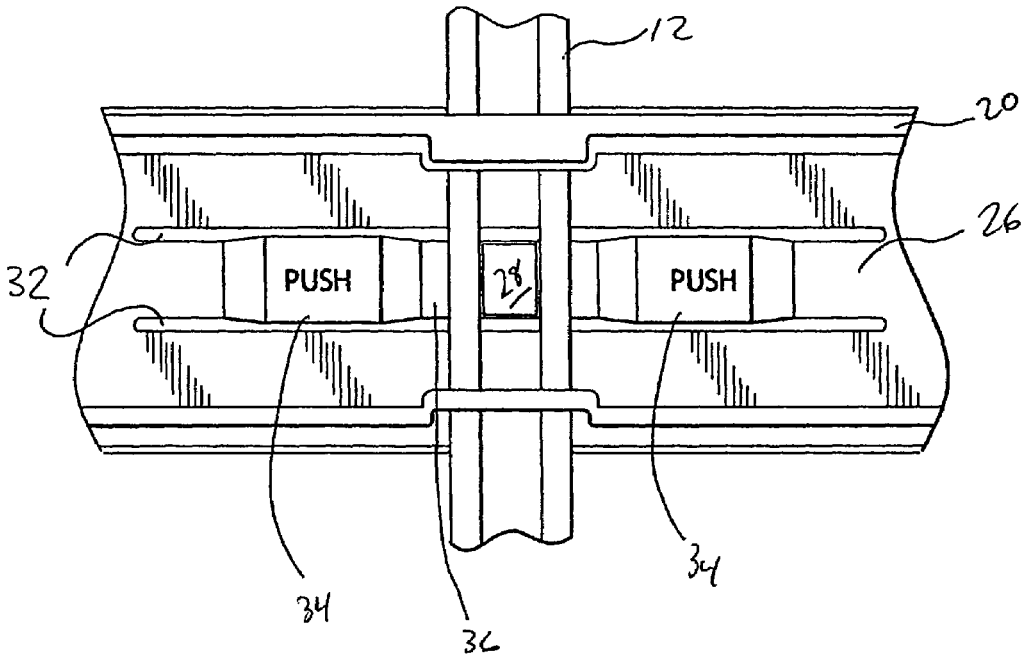
FIG. 2 is a detail of the locking mechanism of the drop loop hanger of the present invention.
Figure 3:
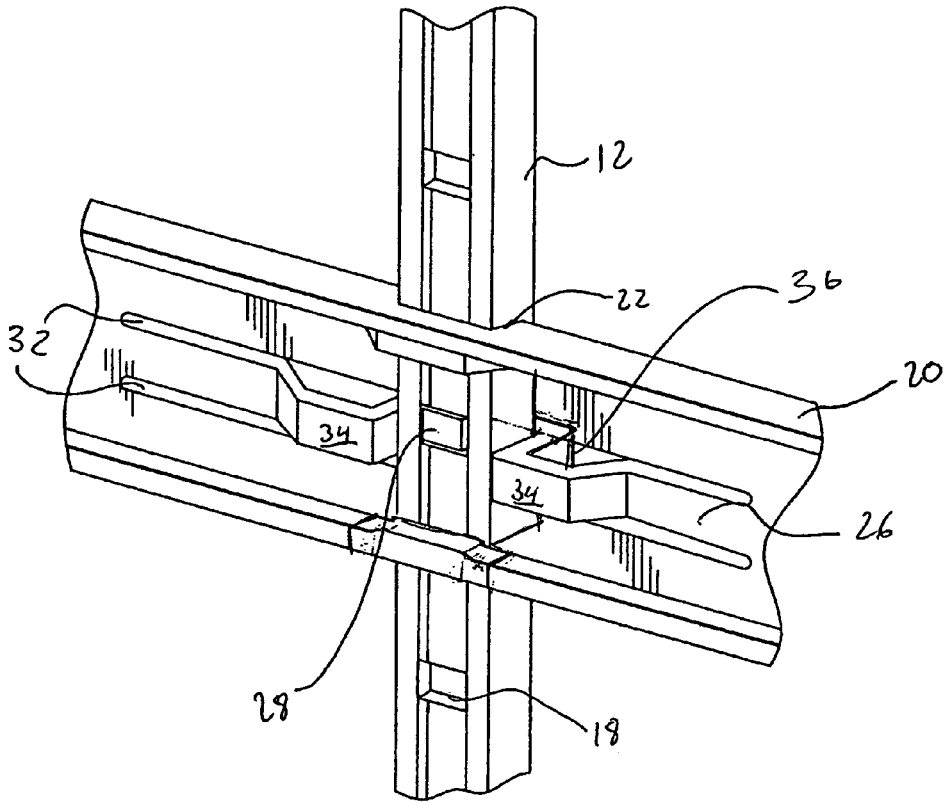
FIG. 3 is a perspective view of the locking mechanism of the drop loop hanger of the present invention.

As shown in FIGS. 2 and 3, resilient band 26 may be formed integrally with support member 20 and is defined by horizontal grooves 32 above and below resilient band 26. Ideally, resilient band 26 has formed therein shoulders 34 which are connected by U-shaped channel 36. Locking pin 28 extends out from the base of channel 36 and may also be formed integrally therewith. As shown, elongated body 12 is locked in place between groove 22 and channel 36 because resilient band 26 is biased such that locking pin 28 is held in place within an aperture 18.

Figure 4:
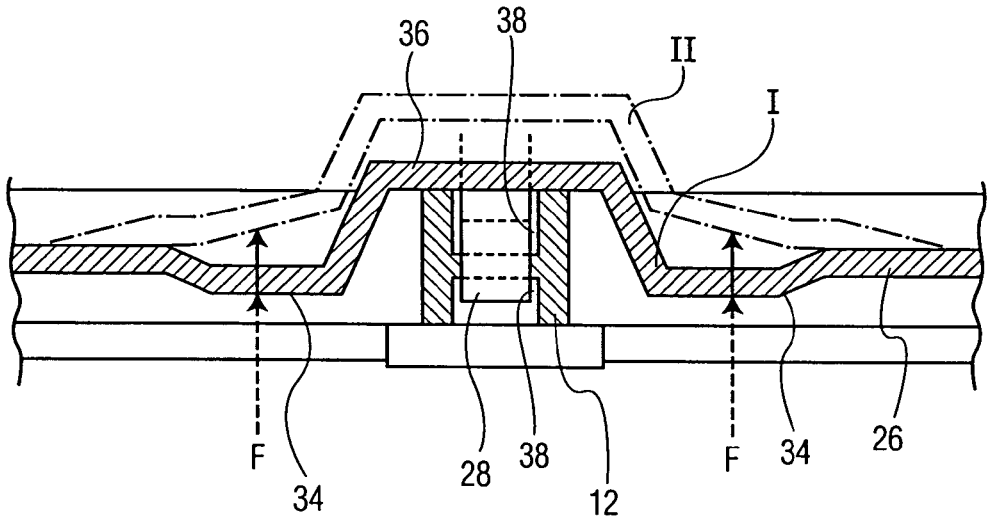
FIG. 4 is a cross-section of the latching mechanism as shown in FIG. 2.

FIG. 4 is a cross section of FIG. 2 showing the locking mechanism in greater detail. The position of resilient band 26 indicated by I corresponds to the locked position shown in FIGS. 2 and 3. In position I, locking pin 28 is inserted within an aperture 18 in elongated body 12, preventing support member 20 from moving relative to elongated body 12. However, upon application of force F, the bias of resilient band 26 is overcome, causing resilient band 26 to deflect away from the axis of elongated body 12 to position II, causing locking pin 28 to withdraw from the aperture 18 into which it was inserted.

Thus, while resilient band 26 is in position II, support member 20 can freely move relative to elongated body 12. Upon release of force F, resilient band 26 is again biased against elongated body 12, resulting in the insertion of locking pin 28 into an aperture 18, locking the components 12 and 26 together. Ideally, resilient band 26 is formed from the same material as support member 20, provided that the material is sufficiently flexible to allow resilient band 26 to be deflected away from the axis of slot 22 upon the application of force F and sufficiently resilient to return to position I after force F is removed. For ease of manufacture, such material ideally includes injection-moldable plastics, although a wide variety of metals could also be used alone or in combination with other materials to achieve the same results.

Also shown in FIG. 4, elongated body 12 ideally has an H-shaped cross-section. As will be recognized by a person of skill in the art, the cross-sectional shape of elongated body 12 contributes to the rigidity and strength and reduced material requirements of elongated body 12. However, a particular advantage of an H-shaped cross-section is the formation of grooves along the length of elongated body 12 which receive locking pin 28 while resilient band 26 is in position II. During adjustment of support member 20, locking pin 28 follows groove 38 until locking pin 28 is received by an aperture 18. This arrangement provides a measure of stability to drop loop 10 while the components are adjusted.

Referring again to FIG. 1, elongated body 12 is comprised of segment 12', which extends from loop 14 to horizontal support member 20, and segment 12" which is the tail portion that extends below support member 20. After adjustment and installation of the drop loop hanger 10, segment 12" may be broken off and discarded. Periodic indentations (not shown) can be provided along the length of elongated body 12 to facilitate breaking the tail off by hand.

It will be apparent to those skilled in the art that more than one horizontal support member 20 can be attached to a single elongated body 12. Further, the fasteners 24 on horizontal support member 20 can be any one of a number of clamps, hooks, rings, snaps, etc. which may be appropriate to a particular type of lower garment. In this regard, for example, garments can be shipped with a lower support member 20 already attached so that the process of receiving and displaying the garments on standardized hangers can be simplified. In this case, a retail facility may wish to keep a number of elongated body 12 in stock, such components being easy to store in volume because of their convenient size and shape.

While the present invention has been illustrated in some detail according to the preferred embodiment shown in the foregoing drawing and description, it will become apparent to those skilled in the pertinent art that variations and equivalents may be made within the spirit and scope of that which has been expressly disclosed. Accordingly, it is intended that the scope of the invention be limited solely by the scope of the hereafter appended claims and not by any specific wording in the foregoing description.

The invention claimed is:

1. A drop loop garment hanger for use with a conventional hanger, said drop loop garment hanger comprising:

a substantially vertical elongated body having a loop at a top end thereof for receiving a hook of said conventional hanger and terminating at a bottom end, said elongated body having a plurality of apertures disposed therein, spaced along the vertical dimension thereof; and a substantially horizontal support member having a slot having a vertical axis adapted to slidably receive said elongated body and having an integral latch mechanism adapted to selectively engage said apertures, said latch mechanism comprising;

a resilient horizontal band attached to said horizontal support member and intersecting with the vertical axis of said slot and biased against said elongated body; and a locking pin protruding from said resilient band and oriented toward said vertical axis, wherein movement of said elongated body within said slot is followed by said horizontal band and said locking pin selectively engages one of said apertures preventing vertical movement of said horizontal support member relative to said elongated body.

2. The drop loop hanger of claim 1 wherein said resilient horizontal band comprises a U-shaped channel attached at each end thereof to said horizontal support member by a shoulder portion, each of said shoulder portions extending outward from said channel, whereby said resilient horizontal band can be deflected by application of manual force on said shoulder by a user to selectively disengage said locking pin.

3. The drop loop hanger of claim 2 wherein said elongated body has, in cross-section, an H-shaped profile, said profile forming a vertical groove on each of two diametrically opposed surfaces on said elongated body and wherein said locking pin follows one of said grooves when said locking pin is selectively disengaged.

4. The drop loop hanger of claim 3 wherein said apertures intersect both of said grooves and wherein said apertures have a horizontal dimension less than the width of said grooves.

5. The drop loop hanger of claim 1 wherein a bottom end of said elongated body terminates in a tapered region.

6. The drop loop hanger of claim 1 wherein said substantially horizontal support member and said latch mechanism are manufactured from a single piece of material.

7. The drop loop hanger of claim 6 wherein said single piece of material is injection-molded plastic.

* * * * *